US006318003B1

(12) United States Patent
Heismann

(10) Patent No.: US 6,318,003 B1
(45) Date of Patent: Nov. 20, 2001

(54) SNOW THROWER

(75) Inventor: Richard A. Heismann, Jackson, TN (US)

(73) Assignee: Murray, Inc., Brentwood, TN (US)

( * ) Notice: Subject to any disclaimer, the term of this patent is extended or adjusted under 35 U.S.C. 154(b) by 0 days.

(21) Appl. No.: 09/605,720

(22) Filed: Jun. 27, 2000

Related U.S. Application Data

(60) Provisional application No. 60/148,218, filed on Aug. 12, 1999.

(51) Int. Cl.[7] ..... E01H 5/00

(52) U.S. Cl. ..... 37/257

(58) Field of Search ..... 37/244, 257, 258, 37/260, 261; 56/11.2, 11.8, 17.2; 172/114; 474/84–86, 148–150

(56) References Cited

U.S. PATENT DOCUMENTS

Re. 33,726 * 10/1991 Thorud et al. ..... 37/244
3,580,351 * 5/1971 Mollen ..... 180/53 D
3,691,860 * 9/1972 Danuser ..... 74/242.1
4,255,879 * 3/1981 Greider ..... 37/244
4,294,027 * 10/1981 Edwards ..... 37/257
4,322,896 * 4/1982 Miyazawa et al. ..... 37/244
4,756,101 * 7/1988 Friberg et al. ..... 37/244
5,434,118 * 7/1995 Cobile ..... 56/13.4
6,022,285 * 2/2000 Firdaus ..... 474/86

* cited by examiner

*Primary Examiner*—Robert E. Pezzuto
(74) *Attorney, Agent, or Firm*—Kevin E. Joyce

(57) ABSTRACT

A snow thrower of compact proportions is obtained by a single piece housing which supports an engine having a vertical output shaft extending within the housing. The housing also supports a horizontally disposed auger drive shaft. A belt drive connects the engine drive shaft and the auger drive shaft via a pair of idler pulleys, one disposed at an inclined angle and the other being mounted on an idler arm pivotally mounted within the housing. The belt and idler arm pass through an opening in the housing to achieve the belt drive connection. A control member is provided to move the idler arm to tension the belt for driving the auger drive shaft or to relax the belt to interrupt the belt drive connection. In the latter condition, the belt is braked while retaining light contact between the engine and auger drive pulleys.

12 Claims, 2 Drawing Sheets

SNOW THROWER

This application claims the benefit of U.S. Provisional Application No. 60/148,218, filed Aug. 12, 1999.

BACKGROUND OF THE INVENTION

1. Field of the Invention

The present arrangement relates to an improved snow thrower assembly characterized by its compactness.

2. Prior Art

Conventional snow throwers are relatively large pieces of equipment resulting in significant part from the arrangement used for transmitting power from the engine to an auger which moves snow to a discharge chute. The auger typically is disposed for rotation about a horizontal axis. This requires, therefore, that the engine have either a horizontal output shaft or that the output from a vertical output shaft be translated for rotation about a horizontal axis for use by the auger. In either case, such mechanisms are normally cumbersome so as to contribute to the overall size of a snow thrower.

SUMMARY OF THE INVENTION

The present invention permits a single piece housing to support the snow thrower's engine, wheels and auger drive shaft. A belt drive is connected between a vertical output shaft of the engine and the horizontally disposed auger drive shaft. An idler arrangement is employed which permits the belt drive to be selectively engaged. When the belt drive is disengaged, the belt is braked without separation occurring between the belt and drive arrangement for the driver. The overall arrangement of components results in a snow thrower which is extremely compact.

BRIEF DESCRIPTION OF THE DRAWINGS

The invention now will be described in greater detail with respect to the accompanying drawings wherein.

DETAILED DESCRIPTION OF A PREFERRED EMBODIMENT OF THE INVENTION

Figure 1:
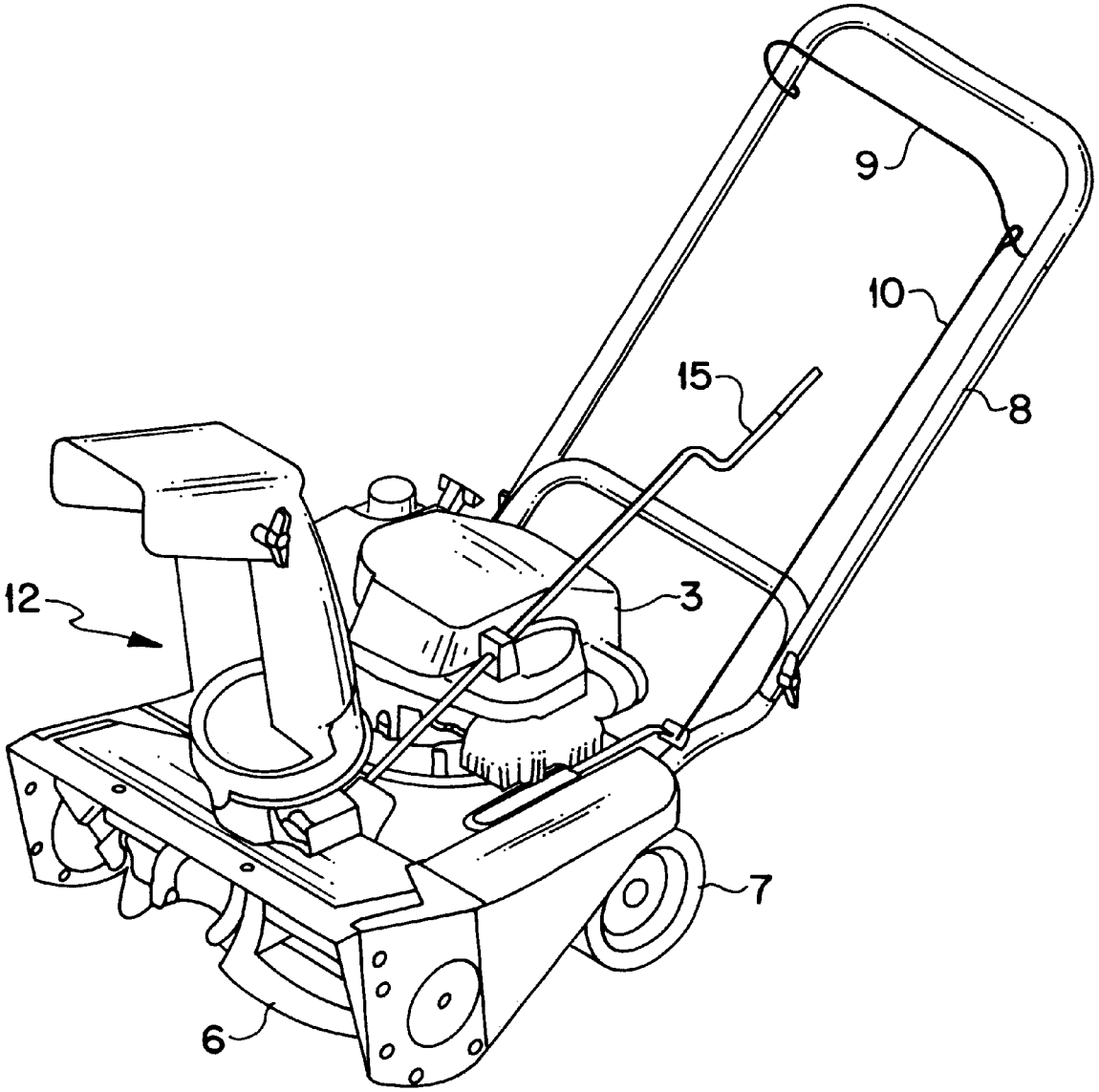
FIG. 1 is a perspective view of a snow thrower according to the invention.
Figure 2:
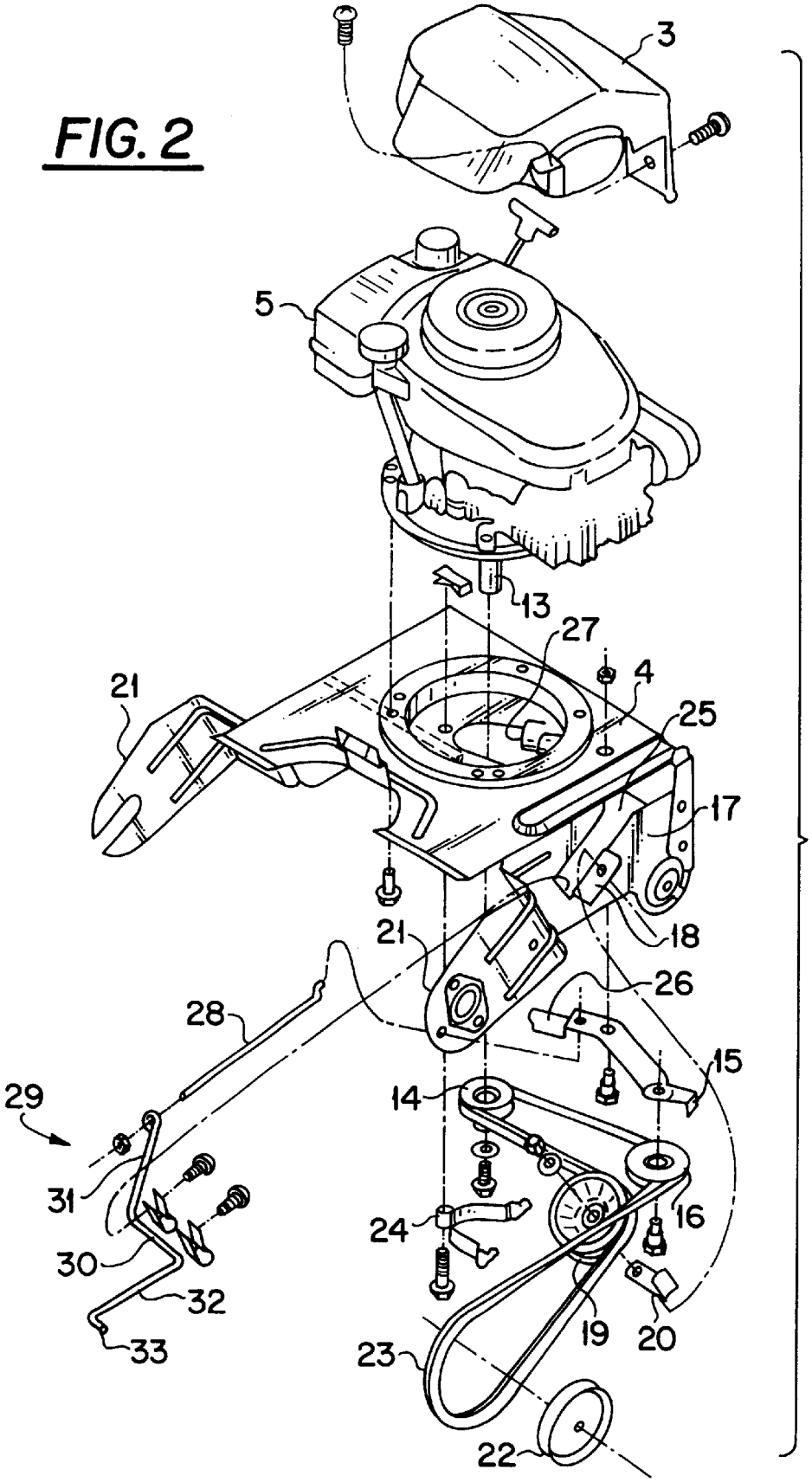
FIG. 2 is a view of a portion of the snow thrower shown in FIG. 1 illustrating, in exploded fashion, an engine and drive connection for powering an auger portion of the snow thrower.

Referring to FIG. 1, a housing-supported engine located beneath a cover 3 is provided with a vertical output drive shaft 13 (FIG. 2) which passes through the upper surface of a housing 4 (FIG. 2). The output shaft is connected to an auger 6, supported within a forward portion of a single piece housing 4 by a drive connection to be described hereinafter. The rear portion of the housing is supported by wheels 7. A handle 8 extends rearwardly of the housing. A control bar 9 is pivotally connected to the upper portion of handle 8 and is capable of being actuated by an operator. The control bar 9 is connected by a cable 10 to the drive connection between the engine's output drive shaft and auger 6. During operation of the engine, the operator selectively actuates the control bar 9 to complete the drive connection between the engine and auger 6 whereby snow is moved by the auger and is discharged from the housing through a discharge port provided in the housing above the central portion of auger 6. An adjustable discharge chute 12 is joined to the port to direct snow thrown by auger 6. A control rod 15 extends from one of its ends, positioned adjacent to handle 8, to a worm gear (not shown) which is joined to the rod's opposite end. The worm gear is positioned in operative relationship with chute 12 to cause the chute to rotate about a vertical axis in response to actuation of control rod 15 to thereby control the direction of snow discharged from the snow thrower. The distance the snow is thrown is established by the position of a deflector which is pivotally connected about a horizontal axis to the top of chute 12.

Referring now to FIG. 2, the drive connection between engine 5 and auger 6 will be described.

The engine 5 is secured to the upper surface of housing 4 with its vertically oriented output drive shaft 13 extending through an opening in the housing. A drive pulley 14 is joined to shaft 13 in conventional fashion. The housing 4 is formed with dependent sidewalls 17 on opposite sides thereof. The sidewalls support wheels 7 in conventional fashion. A sidewall 17 on one side of housing 4 also is provided with an opening 25 having inclined and horizontal portions. The inclined portion is formed to provide an inclined platform 18 disposed at an angle of approximately 45° to horizontal. An idler arm 15 is pivotally connected to the underside of housing 4 and projects through opening 25. An idler pulley 16 is joined to an end of the idler arm outside of the housing. Platform 18 supports a further idler pulley 19 and a belt guard 20. The housing 4 also includes a pair of substantially parallel arms 21 projecting forwardly from the respective sidewalls 17. The arms rotatably support a horizontally oriented drive shaft (not shown) of the auger 6, the auger drive shaft having a drive pulley 22 secured to one of its ends proximate idler pulley 19. A twisted belt 23 is disposed about pulleys 14, 16, 22 and 19 so as to interconnect the output drive shaft 13 with the auger drive pulley 22. The belt is guided relative to pulleys 19 and 14 by belt guides 20 and 24, respectively, the latter being secured to the underside of housing 4.

The control cable 10 shown in FIG. 1 is joined to the idler arm 15 to selectively tension belt 23 when control bar 9 is actuated. This causes rotation of the engine's output drive shaft 13 to be translated to the auger drive pulley 22 to operate auger 6. When the bar 9 is released, a spring (not shown) connected between idler arm 15 and housing 4 pivots the idler arm in a direction to relax the belt's tension to interrupt the drive connection between the engine 5 and the auger 6.

The inner end 26 of idler arm 15 is provided with a downwardly extending ear (not visible in FIG. 2) which is positioned adjacent drive pulley 14 within the path defined by belt 23. The housing 4 is formed with a similar downwardly extending ear 27 located on the opposite side of the belt from the idler arm's ear. When control bar 9 is released to relax the tension on belt 23 in the manner which has been described, the inner end of idler arm 15 is moved towards ear 27 to pinch belt 23 therebetween so as to brake the belt while retaining light belt contact with drive pulley 14.

One end of a connecting rod 28 is pivotally connected to idler arm 15 between the arm's inner end 26 and the pivotal connection of arm 15 to housing 4. The opposite end of rod 28 is connected to a wire element 29 formed with a horizontally disposed central portion 30 having extensions 31 and 32 at opposite ends thereof which meet portion 30 at 90° angles. However, portion 30 and extension 31 lie in a substantially vertical plane, while portion 30 and extension 32 lie in a substantially horizontal plane. Portion 30 is pivotally mounted to an inclined platform (not shown)

formed at the lower end of opening 25 in the housing sidewall 17. When so mounted, a substantially horizontal projection 33 extending from the free end of extension 32 is positioned adjacent auger drive pulley 22 within the path defined by belt 23. When control bar 9 is released to relax the tension on belt 23 as previously described, the resultant movement of idler arm 15 is translated by control rod 28 to pivot element 29 about an axis defined by portion 30. This results in projection 33 engaging the inner surface of belt 23 to retain light contact between the belt and auger drive pulley 22.

When the control bar is actuated for the purpose of establishing a belt drive connection between pulleys 14 and 22, the resultant pivotal movement of idler arm 15, causes the inner end 26 of the idler arm to be moved away from ear 27 to release the braking of belt 23, and element 29 is pivoted in a direction which moves projection 33 away from engagement with belt 23.

With the arrangement just described wherein an engine 5 having a vertically oriented output drive shaft 13 is coupled by a belt drive connection to an auger 6 oriented to rotate about a horizontal axis extending transversely to the direction of movement of the snow thrower, an extremely compact assembly is achieved. For improved performance and decreased noise, it is preferred that a four cycle engine 5 be used.

What is claimed is:

1. A snow thrower comprising a housing for supporting an engine having a vertical output shaft which extends downwardly to within the housing;

a drive pulley joined to said shaft;

an auger drive shaft supported by said housing for rotation about a substantially horizontal axis;

an auger drive pulley joined to the auger drive shaft outside of said housing;

an idler arm pivotally connected within said housing;

an opening in said housing through which one end of the idler arm extends;

a first idler pulley rotatably joined to said one end of the idler arm outside of the housing;

a second idler pulley rotatably connected to said housing, said second idler pulley lying in an inclined plane;

a belt extending about said drive pulley, auger drive pulley and said idler pulleys and passing through said opening; and a control member joined to said idler arm, said control member being selectively operable to pivotally move the idler arm between a first position in which the first idler pulley tensions the belt to translate rotation of the drive shaft to rotation of the auger drive shaft and a second position in which the belt is not tensioned by the idler pulley.

2. A snow thrower according to claim 1, wherein said housing is formed as a single piece.

3. A snow thrower according to claim 1, wherein said second idler pulley is located within said opening.

4. A snow thrower according to claim 1, wherein said vertical output shaft passes through a second opening in the housing, said snow thrower further comprising:

a first substantially vertically extending surface formed adjacent the second opening and the drive pulley at a location outside of a path defined by said belt; and a second substantially vertically extending surface formed in an opposite end of the idler arm within the housing, said second surface being positioned on the opposite side of the belt from the first surface whereby when the control member is operated to move the idler arm to said second position, said second surface is moved towards the first surface to pinch the belt therebetween so as to brake the belt.

5. A snow thrower according to claim 1, further comprising:

a control rod pivotally connected to said idler arm;

a member pivotally mounted to the housing, said member having a first end joined to the control rod and a second end having a projection which lies adjacent an inside surface of the belt proximate the auger drive pulley, whereby when said control member is moved to said position, movement of the idler arm is translated by the control rod to said member to pivot the member in a sense which brings the projection into engagement with the belt to retain the belt in contact with the auger drive pulley.

6. A snow thrower according to claim 4, further comprising:

a control rod pivotally connected to said idler arm;

a member pivotally mounted to the housing, said member having a first end joined to the control rod and a second end having a projection which lies adjacent an inside surface of the belt proximate the auger drive pulley, whereby when said control member is moved to said position, movement of the idler arm is translated by the control rod to said member to pivot the member in a sense which brings the projection into engagement with the belt to retain the belt in contact with the auger drive pulley.

7. A snow thrower according to claim 4, wherein said housing is formed as a single piece.

8. A snow thrower according to claim 7, wherein said housing includes a pair of projecting arms on opposite sides of the housing for supporting the auger drive shaft.

9. A snow thrower according to claim 8, wherein said second idler pulley is located within said opening.

10. A snow thrower according to claim 6, wherein said housing is formed as a single piece.

11. A snow thrower according to claim 10, wherein said housing includes a pair of projecting arms on opposite sides of the housing for supporting the auger drive shaft.

12. A snow thrower according to claim 11, wherein said second idler pulley is located within said opening.

* * * * *